United States Patent [19]

Collini

[11] Patent Number: 4,957,611

[45] Date of Patent: Sep. 18, 1990

[54] PROCESS AND APPARATUS FOR THE ELECTRO-DEPOSITION OF COPPER SHEETS ON THE CATHODIC SIDES OF BIPOLAR ELECTRODES MADE OF LEAD

[76] Inventor: Rinetto Collini, c/o Fiammenghi Fiammenghi Via Quattro Fontane 31, I 00184 Roma, Italy

[21] Appl. No.: 305,990

[22] PCT Filed: Jun. 3, 1987

[86] PCT No: PCT IT87/00052
§ 371 Date: Dec. 1, 1988
§ 102(e) Date: Dec. 1, 1988

[87] PCT Pub. No.: WO87/07652
PCT Pub. Date: Dec. 17, 1982

[30] Foreign Application Priority Data

Jun. 6, 1986 [IT] Italy ..... 48112 A/86

[51] Int. Cl.[5] ..... C25C 1/12; C25C 7/00; C25C 7/06

[52] U.S. Cl. ..... 204/106; 204/237; 204/268; 204/269; 204/270

[58] Field of Search ..... 204/268, 269, 106, 228, 204/267, 270

[56] References Cited

U.S. PATENT DOCUMENTS 1,738,372 12/1929 Edgeworth-Johnstone ..... 204/5
4,025,413 5/1977 Nightingale et al. ..... 204/228 X
4,033,839 7/1977 Harvey et al. ..... 204/108
4,061,559 12/1977 Kitamura et al. ..... 204/106
4,282,082 8/1981 Cook et al. ..... 204/269 X
4,377,445 3/1983 Grimes ..... 204/228 X

FOREIGN PATENT DOCUMENTS 2528075 12/1983 France .

*Primary Examiner*—Donald R. Valentine
*Attorney, Agent, or Firm*—Edward A. Sokolski

[57] ABSTRACT

An electrolytic process and apparatus for the production of copper cathodes from acid solutions of copper sulphate by a direct electro-deposition of said metal on lead bipolar electrodes arranged "in series" into electrolyzers consisting of lead electrodes (3) juxtaposed to special frames (1) adapted to define together with said electrode electrolytic cells, absolutely separated from each other and adapted to prevent any formation of shunt currents. The alternating succession of the frames (1) and electrodes (3) is carried by a support structure and is then compressed at the ends thereof by means of two heads and is hermetically sealed by means of packing means interposed between a frame and the adjacent ones. The process can be also applied to other metals other than the copper.

7 Claims, 5 Drawing Sheets

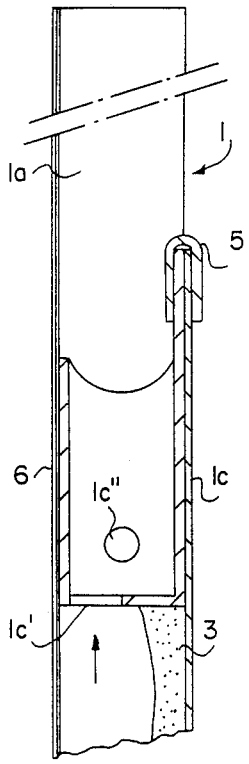
FIG. 6
FIG. 10
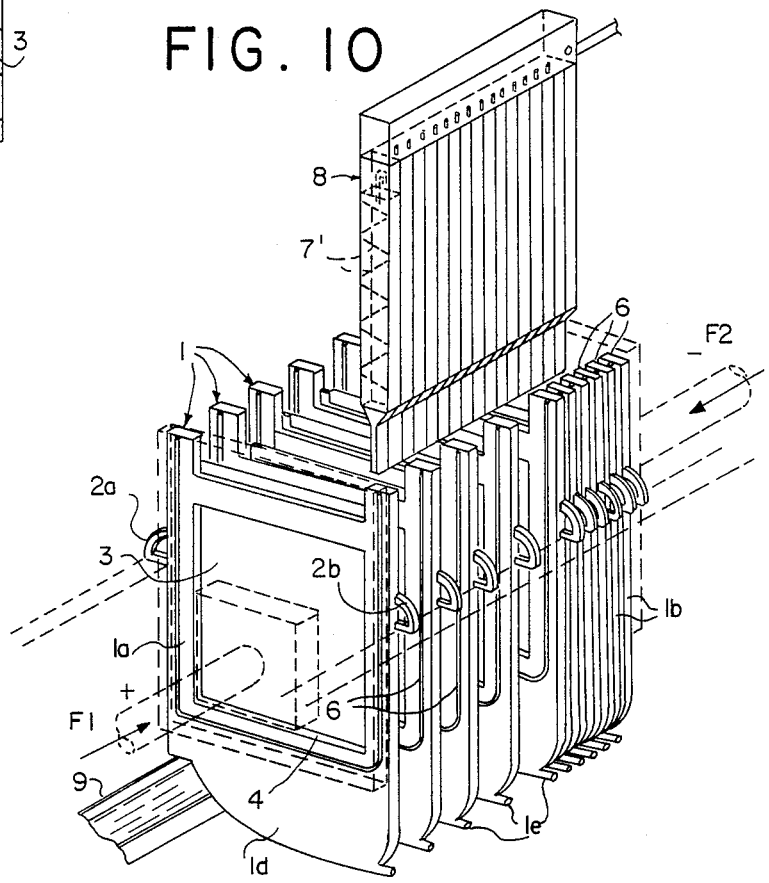

PROCESS AND APPARATUS FOR THE ELECTRO-DEPOSITION OF COPPER SHEETS ON THE CATHODIC SIDES OF BIPOLAR ELECTRODES MADE OF LEAD

The invention relates to a process and apparatus for an electro-deposition of a removable copper layer or sheet or the cathodic sides of bipolar lead electrodes.

It is well known in the art that when a solution of copper sulphate, $CuSO_4$, is subjected to electrolysis into an electrolytic cell, the positive ions $Cu^{++}$ perform a migration towards the negative pole or cathode, where the electrons coming from the outer circuit will be neutralized, so as to create a layer or deposit of metallic copper on the electrode.

Of course, said layer of metallic copper is created at charge of the cupric ions of the electrolytic solution. Therefore, if a replacement of those ions, which have been removed with a new supply of new ions, would not be provided, said ions will be very soon exhausted and therefore the process should stop.

The replacement of new $Cu^{++}$ ions in the electrolytic solution,—which is necessary for the operation of any electrolytic process,—can e obtained either by the direct solubilization of the metal, i.e. by the use of copper anodes, which, under the effect of the passage of the electric current, are caused to pass in the solution, or by a supply of a regenerated solution, i.e. enriched in $Cu^{++}$ ions, in substitution of that one which gets weaker and weaker of said ion content.

As result thereof, the production of the copper layers can be carried out according to the following two procedures:

By the use of soluble electrodes; i.e. by subjecting copper electrodes, as anodes, to an electrolysis process, so that, under the effect of the electric current, copper passes in the solution in an amount equal to that of the copper that deposits on the cathodes;

By the use of insoluble electrodes, as anodes; i.e. by the use of insoluble electrodes (usually lead electrodes); in this case it will be necessary to make up for the loss of cupric ions, which, when they deposit on the cathode at their metal state, are thus removed from the solution, so that it becomes necessary that they have to be replaced by means of an addition of a solution enriched by $Cu^{++}$ ions.

The electrolytic process is usually carried out in tanks which contain: the electrolytic solution of copper sulphate acidified by sulphuric acid; and a plurality of electrodes consisting of an alternating succession of anodes and cathodes dipped into said solution. Said tanks are provided with electric connectors for the feeding of electric current to said electrodes. In its turn, an electrolysis plant, is constituted of a plurality of electrolysis tanks.

It is also known the U.S. Pat. No. 1,738,372 which discloses an apparatus for an electrodeposition of metals from solutions of their salts.

The apparatus comprises a succession of electrolyzing cells formed by a number of closely positioned electrodes in the form of sheets, normally insoluble, separated by electrically insulating perforated packing pieces, and held together in a pack, but disassemblable formation by pressing means, in particular by an adjustable longitudinal through screw. In said apparatus, therefore, the electrolyte flow passes through the succession of electrolytic cells.

As far as the electrolytic processes are concerned, it is also known that they differ from each other, by the manner by which the electric connection of the electrodes is performed, being possible to arrange the electrodes, either "in parallel" or "in series".

Unlike the arrangement "in parallel"usually employed in the process, either with the use of soluble electrodes, or with the use of insoluble electrodes, the arrangement "in series" has been up to the present applied only with the use of soluble electrodes, formed by plates made of copper to be refined, which,—as the current passes therethrough under effect of the electric field—, are charged, positively on one side and negatively on the opposite one thereof, so that the material of the electrodes passes in the solution from the positive side thereof, i.e. the anodic side, and at the same time on the negative side, i.e. the cathodic side, the electrodes grow in their thickness owing to the electrolytic deposit which is being to be created.

The present invention relates to an electrolytic process based on the last aformentioned method, i.e. which concerns the electrolysis of solutions of copper sulphate acidified by sulphuric acid (which from now on will be called simply "electrolyte") by the use of bipolar lead electrodes arranged "in series", taking advantage of the characteristic of the so arranged electrodes, i.e. their characteristic of acting on one of their sides as anodes and on the opposite side as cathodes, so as to obtain directly the formation of copper layers or sheets on the surface of the electrodes acting as cathode i.e. the surface having a negative polarity that will be called from now on "cathodic side" of the electrodes, while the opposite surface having positive polarity will be called "anodic side".

The choice of the lead for the electrodes is due to the fact that such a material, besides of having the quality of being insoluble in the electrolyte, and having also a sufficient electric conductivity as well as a resistance to the anodic oxidation, is further more sufficiently adapted, owing to its ductility, to permit the removal of the copper layers or sheet which have been produced on the cathodic sides of the electrodes, as well as to be able to then again well flatten said electrodes in order to allow their further re-use.

A standard lead plate of the market having a thickness of 1 mm has been found to be adapted, for this purpose without needing any further treatment.

Owing to the semplicity of this process and on account of the reduction to the minimum of the electric connections that is the characteristic of an arrangement "in series", said process has been found to be very advantageous as compared with other known electrolytic processes. However for the industrial realization thereof, the following conditions have to be satisfied:

I—The copper layers or sheets, which in the course of the electrolysis are going to be formed on the lead electrodes, cannot found a suitable support on the electrodes, which are clearly unadapted for such a purpose, but, on the contrary, they have to find a reliable support on a special support frame. Furthermore the electrode surface on which after all the productive capacity of the plant depends in a measure directly proportional, must be sufficiently large so as to be adapted for an industrial use.

II—The operations which have to be carried out in order to put said electrodes in their operative condition at the beginning of the electrolysis cycle and in order to permit their removal from said operative position at the end of each cycle, have to be of a very easy performance.

III—It must be prevented to the electrolyte of each cell ("cell" will be here named each single element of the electrolytic system, that in the presence of electrolyte each electrode will form either with the immediately preceding electrode or with the immediately successive one) any contact of said electrolyte must be prevented with those circulating in the other cells. On the contrary, the electric current, instead of passing through the electrodes (which, on account of the layer of dioxide that is formed on the anodic side thereof under the electrolysis effect, offers a high electric resistance) would pass nearly wholly through the electrolyte (thus creating the so called shunt currents) and as a result thereof, except on the first electrode having negative polarity no other deposit of metal would be obtained.

IV—At last, in each of the cells, in which the electro deposition system can be considered subdivided by the electrodes, a nearly continuous circulation of fresh electrolyte has to be assured, so as to obtain always a supply of new electrolyte enriched in $Cu^{++}$ ions in substitution of those which are going to be removed. As far as the apparatus is concerned, it is to be pointed out that according to the present invention, instead with the use of electrolysis tanks, with the employ of a structure slightly similar (in its external configuration, but not in its operative function), to that disclosed in the above U.S. Pat. No. 1,738,972. More in particular, the present invention provides to use, as electrically insulating packing pieces interposed between the bipolar cathodes modular elements frames, by means of which the electrodes can be assembled, in a pack disposition, so that such an apparatus is constituted of a structure similar to that of a filter press, namely which consists of a plurality of said modular frames, arranged in an alternating succession with said lead electrodes. Said pack structure is hermetically closed at its ends by means of heads. Furthermore it is hermetically closed between a frame and the adjacent ones by means of peripheral suitable packing means. Therefore it can have a configuration of a tank subdivided by the electrodes in so many cells as the frames are.

Said frames are made of an electrically insulating material which must be corrosion-resisting, such, for instance, the PVC or other plastic material having similar characteristic.

Each frame has a structure constituted of hollow members so as to permit circulation of the electrolyte therein, as will be better illustrated thereinafter. Its lower portion is convex and gradually sloping down in order to permit to obtain the whole emptying of the hollow frame through a discharge means provided at the lowermost part thereof.

The process, the apparatus, the electrodes and the modular elements or frames of the present invention will be now described in a more detailed manner, with reference to the accompanying drawings, in which:

FIG. 6 is detail in an enlarged scale, of the sectional view of FIG. 5;

FIG. 10 shows a perspective view of a series of elements during their assembling step.

Figure 1:
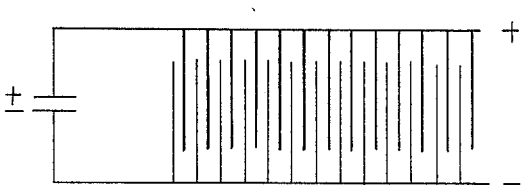
FIG. 1 is a diagrammatic view of the electrodes of a conventional electrolysis apparatus, which are arranged "in parallel"
Figure 2:
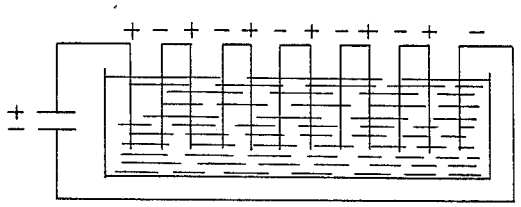
FIG. 2 shows diagrammatically the electrodes of a conventional electrolysis apparatus, which are arranged "in series"
Figure 3:
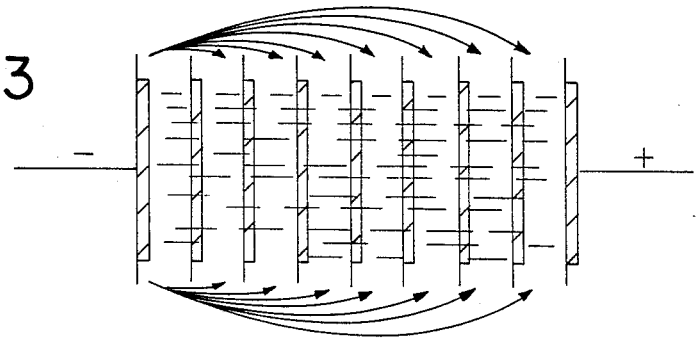
FIG. 3 shows diagrammatically an arrangement "in series" of the electrodes; on this figure some of the paths of the shunt currents are indicated, which could be created, if they are not prevented by suitable means.
Figure 4:
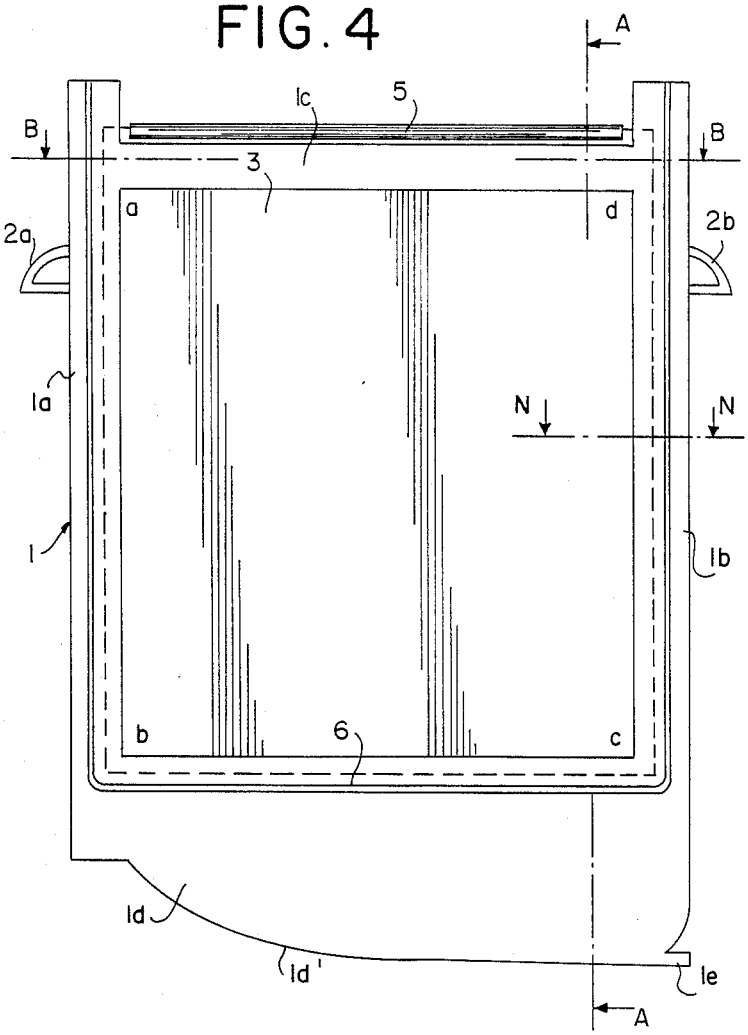
FIG. 4 shows the front view of a modular element according to the present invention.
Figure 5:
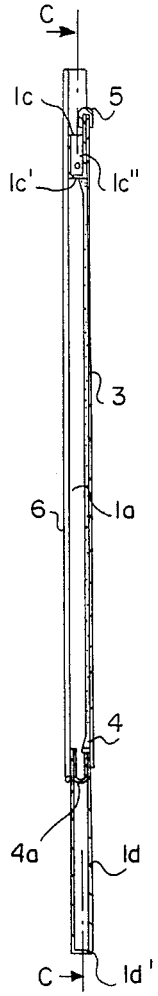
FIG. 5 is the longitudinal sectional view taken on line A—A of FIG. 4.
Figure 7:
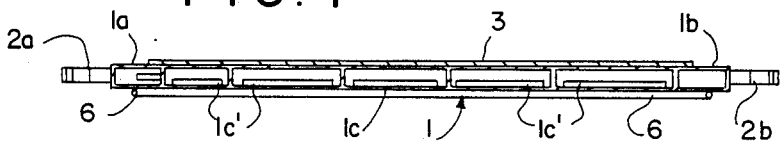
FIG. 7 shows the cross section taken on line B—B of FIG. 4.

As can be seen in FIG. 4, each modular composable element, i.e. the frame 1 in question,—which has, as aforesaid, a frame structure—, comprises two vertical members 1*a* and 1*b*, connected to one another at their upper ends by a transverse member 1*c* and at their lower ends by a base member, convex in its lowermost part. The transverse member 1*c*, in its cross section shown in FIGS. 5 and 6, is shaped as a U and has a very narrow base and one of their sides of the U-structure higher than the other one.

The portion of the higher side extending beyond the shorter one, is designed to serve to fix the electrode 3 to the frame 1 by means of a thin bar 5, which has the shape of an inverted U.

The base member 1*d* is provided,—at the lowermost end thereof 1*d*'—, with a discharge means 1*e* for obtaining the complete emptying of the cell at the end of the electrolysis cycle.

The vertical member 1in its inner cavity houses a flow breaker 7, the configuration and function of which will be illustrated thereinafter.

The vertical members 1*a*, 1*b*, the transverse member 1*c* and the base member 1*d* are hollow and the inner spaces thereof are made intercommunicating between theirselves so as to permit the electrolyte circulation, as will be better explained thereinafter.

The upper part of the transverse member 1*c* having a U-shaped cross section is open so as to permit free discharge of the oxigen developping on the anodic side of the electrodes (in an amount equivalent to the copper depositing thereon), as well as to permit possible inspections which, with the use of adapted implements, can also reach the inner space of the cell.

The lower part of the transverse member 1*c*, i.e. the base portion thereof, in the front part of this latter (with regard to the space designed to house the copper sheet to be obtained) is provided with slits 1*c*'; also the element 4 is provided with slits 4', said element 4 having a U cross section and being inserted on the upper part of the base member 1*d*. Said slits are necessary in order to allow that the electrolyte can come out from the inner space of the base member 1*d* into the cell (i.e. in the space interposed between the electrodes) and then come out therefrom together with the oxigen developing on the anode, thence entering in the transverse member 1*c*. On the outer sides of the vertical members 1*a*, 1*b* there are two shoulders 2*a*, 2*b*, respectively for the support of each frame, in its work condition, on guiding support means (not shown).

The configuration of the lead electrodes 3 has a mutual relation with those of the frames 1. The area which is enclosed in the quadrilateral "abcd" (FIG. 4) is called "cathodic surface" and corresponds to the inner outline of the frames 1, while the surface of the electrodes 3 corresponds to that of the cathodic surface, but increased of a peripheral border portion of 8–10 cm near the upper side a–d, and of about 5–6 cm near the other three sides. The presence of said border portions is necessary in order to permit to securely fix the electrodes 3 between a frame and the adjacent one according to the following manner.

A part of the upper border portion of each electrode, i.e. the upper band of said border portion, will be securely connected to the upper part of the higher side of the transverse member 1*c* by means of the thin bar 5 having a cross section like to an inverted U, the function of which is that of permitting to clamp together the upper parts of the electrode 3 and of the transverse member 1*c*. In fact, as the electrode 3 has been so securely connected to the transverse member 1*c*, said electrode remains automatically fixed to this latter and that takes place also since a small protrusion is provided near the edge of the electrode; this protrusion acts in contrast with the higher edge of the structure, so preventing that the electrode can be moved away therefrom and slide downwards.

After having mounted the frames 1 together with the respective electrodes 3 in succession with a pack disposition, one after the other on the guiding support means (not shown), the border portions of all the four edges of the electrodes will remain automatically entrapped between a frame and the adjacent one, when, after having mounted the heads (not shown), the whole structure of said assembly will be pressed, by a suitable external device, between these latter according to the direction indicated by the arrows F1 and F2 in FIG. 10 (just as it takes place in a filter-press). In fact also the upper border portion of the electrodes (the part which is inserted in the bar 5 excepted), will remain clamped between a frame and the adjacent ones, and more precisely between the back side of the transverse member 1*c*, to which the electrode is locked by the bar 5, and the front side of the front transverse member 1*c* of the following frame. The aforementioned difference in height of the two parallel vertical sides of the transverse member 1*c* has been provided exactly for the necessity of leaving sufficient space for receiving said bar 5.

This locking system of the electrodes 3 enables the use, without any difficulty, of lead electrodes in the form of plates or sheets of a thickness of 1 mm and having a cathodic surface of at least 70 $dm^2$ (since such a surface area is industrially convenient).

Figure 9:
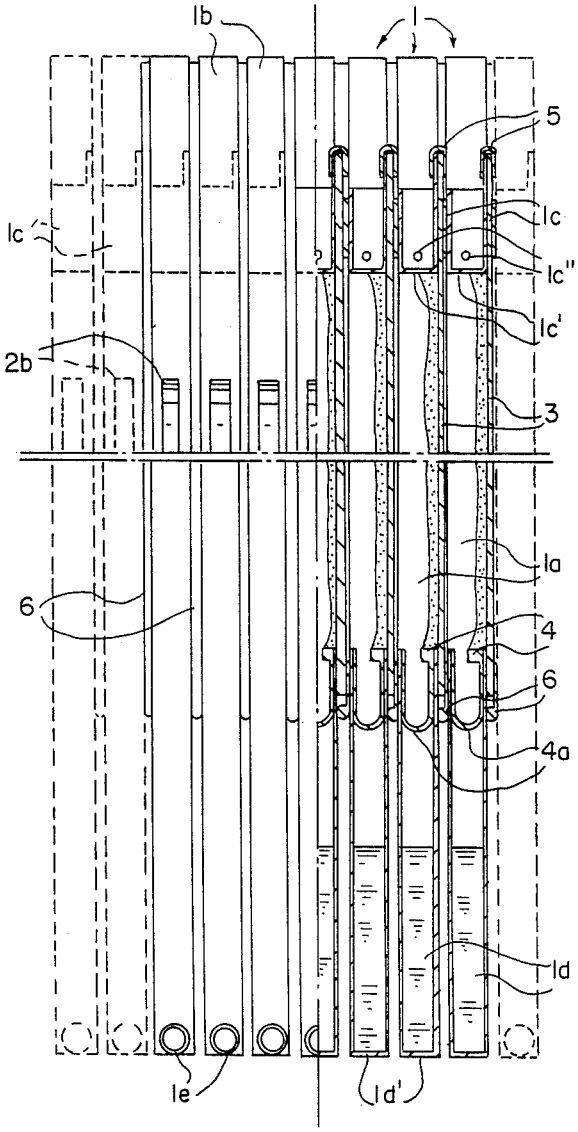
FIG. 9 shows a series of modular elements assembled to each other in their operative position, some of which being shown in their side view and some in a cross sectional view.

The poor initial mechanical resistance of the lead sheets which constitute the electrodes 3 will be progressively increased by the copper layer (which can be seen only in FIG. 9), said layer having a more and more increasing thickness without any risk that tensions between the two metals can be created.

Of course, the configuration of the copper layers or sheets to be obtained will correspond to the outline of the inner space "abcd" of the frames 1, within which said cathodic layers or sheets will be formed. As the electrolysis goes on, the thickness of said cathodic layers will more and more increase, as well as their weight, which for its most part will be supported by the lower member 1*d* of the frame and more in particular on a special lip provided on the element 4 of the transverse member 1*d*, which is open in the remaining upper part thereof.

The copper layers or sheets can be considered adapted to be apt to be sold, after having reached a thickness of 6–7 mm.

Therefore only at this time the apparatus will be emptied of the electrolyte thus their components can be disassembled, while the lead electrodes and the copper sheets, (remain still connected together), i.e. they are at first only separated from the frames.

Afterwards the copper sheets or layers will be, in turn, separated from the respective lead electrodes. This last operation does not offer any difficulty, since to such a purpose it is only necessary to previously coat the cathodic surface of the electrodes, before the beginning of the electrolysis, with a thin layer of oil or grease, so as it is commonly done in the process "in parallel" with the use of "mother plates", in order to remove the so formed cathodic sheets.

As the copper sheets or layers have been removed, the lead electrodes have to be only flattened so as to be made again ready to be used in the next electrolysis cycle and so on, from a cycle to the next one. Therefore the first two conditions, on which is based the task relating to the present invention, are thus satisfied.

As far as the third condition is concerned, it will be evident that the special manner, according to which the electrodes 3 are maintained in their operative position (i.e. with their border portions securely retained between the frames 1), prevents that the electrolyte of each cell can come into contact with those of the other cells; therefore no shunt currents can be created through said paths.

The water-repellent effect of the surface of the frames made of plastic material (which usually present such a characteristic), as well as the thin greasy layer coating the electrodes are "per se" sufficient in order to prevent infiltrations of the electrolyte into possible interstices so that the use of packing means is not even necessary in order to obtain an affidable separation of the electrolytes of the adjacent cells.

On the contrary, it is necessary the provision of packing means 6 (FIGS. 4 to 10) mounted in peripheral position along the outline of the electrodes, in order to ensure a hermetic seal of the apparatus. It is furtherly convenable that said packing element 6 extends with a flat flange underneath the edge portions of the electrodes, so that, in such a manner, said packing means 6 can be more easily applied to the frames 1 and also because, owing to this extended configuration, this packing means, besides acting as a shock absorber, i.e. as a "cushion", interposed between an electrode and a frame, can also ensure a more efficient locking of the electrodes (between a frame and the adjacent one), thus preventing that said electrodes can slide along the rigid and smooth surface of the frame. In order to not make the accompanying drawings too complicate, the flat portions of the packing means 6 have been shown only in FIGS. 6 and 9.

The other paths along which possible derivative or shunt currents could be transmitted, i.e. the conduits through which the electrolyte flows in and out any single cell, are, on the contrary forbidden by the use of suitable devices 7' and 7 respectively, i.e. by the use of the already mentioned electrolyte flow breakers. During the passage of the electrolyte said devices create repeated breakages of the liquid flow which cause thus interruptions of the electric conductivity.

Said devices consist in the combination of a small deposit tank adapted to be emptied under a siphon effect, and of an underlying conduit including superposed sloping wall elements; the siphon serves to break the liquid flow during the storage phase of the electrolyte into the deposit tank, while such a conduit has the function to maintain the flow breakage during the phase in which the electrolyte comes out of said deposit tank and that because the electrolyte volume at each cycle is not sufficient to fill up the whole conduit.

The liquid flow breakers are provided at the input and the output of each cell and therefore there are two of said breakers associated with each cell.

Figure 8:
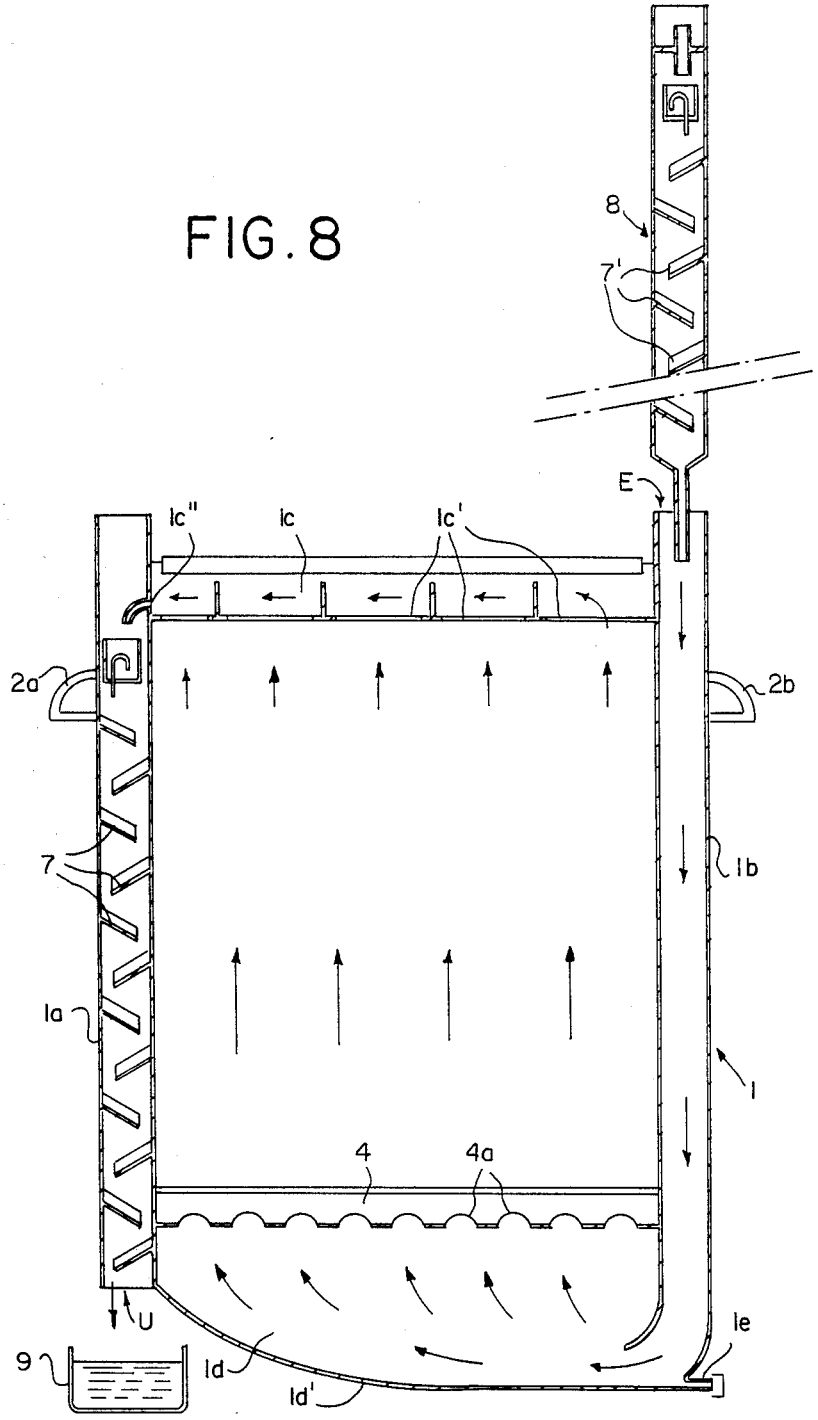
FIG. 8 shows an axial view on line C—C of FIG. 5, where the arrows indicate the travel of the electrolyte.

The last condition is also equally satisfied. The circulation of the electrolyte through each cell is permitted by the inner conduit systems of the frames 1. The supply of the electrolyte to the inlet orifice E of each frame (FIG. 8) takes place through a distributor 8 which fulfils the function of receiving the electrolyte from the storage tank and of distributing the electrolyte (having now again original concentration) in equal amounts or flow rates into the cells; said electrolyte, before reaching each inlet orifice E, is caused to pass through an electrolyte flow breaker 7' (FIGS. 8 and 10), to which reference has been already made. The arrows in FIG. 8 show how the electrolyte circulates in a cell.

After being entered the inlet orifice E, the electrolyte travels along the vertical conduit provided in the vertical member 1*b*, from which said electrolyte goes down into the inner cavity of the base member 1*d* of the frame 1 and therefrom, according to the principle of the communicating vessels, it re-ascends into the interspace between one electrode and the adjacent one, passing through the slits 4*a* of the element 4 mounted in the upper part of the member 1*d* and then it will enter, again in the hollow member 1*c* passing through the slits 1*c'*, provided in the lower portion of the transverse member 1*c*. Then the electrolyte comes out therefrom through the orifice 1*c''* and falls down into the hollow members 1*a* including the electrolyte flow breaker 7, through which it reaches the outlet orifice U; then the electrolyte falls down, at last, into the manifold 9. For the purpose of completing the description, it is to be pointed out that the components of the apparatus are maintained in their operative condition by means of a support framework (not shown in the drawings) on which the frames are suspended and on which therefore the whole weight of the apparatus discharges, and as well as by means of a compression device which serves to press together the succession of frames and electrodes, one against to the other between the two press head of a double ram press, for instance.

These latter structures and devices are conventional and substantially similar to those provided in a filter press, so that it is not necessary that they have to be described in a more detailed manner.

Of course, the end electrodes, i.e. the first and the last ones, are applied directly on the apparatus heads which by means of suitable connecting means are connected to an electric current feeding circuit.

Still for the purpose of completing the description, it is necessary to still say what follows.

It has been assumed that the frames have a thickness of about 2 cm and that their thickness corresponds to the initial distance of the electrodes from each other. Of course, as the electrolysis process goes on, said distance will decrease of an amount equal to the thickness of the copper layer, which deposits on the cathodic side of the electrodes, so that near the end of the electrolytic cycle said distance will become lesser than 1 cm. Evidently, if the thickness of the frames will be increased, a greater distance between the electrodes will be obtained with the advantage of a higher reliability against possible short circuits between an electrode and the adjacent ones, but with the disadvantage of a higher electric resistance of the cells and therefore a higher electric power consumption per product unit. The other dimensions of the frames depend upon the area of the cathodic surface which will be provided. With the provision of a cathodic surface of about 70 $dm^2$, the inner outline of the frames will be a rectangular space abcd with a base of about 80 cm and of a height on 90 cm and accordingly also all the other dimensions will be determined, which will be proportionally calculated in concordance with the preceding ones.

The electrolyte circulation except the little discontinuity of fluid flow (due to the presence of the flow breakers 7 and 7'), is obtained in a continuous manner by means of a pump which receives the electrolyte, coming out of each cells of the apparatus and which will be caused to enter into a reactor which provides to re-establish the original cation concentration. Afterwards the electrolyte returns to the storage tank so as to complete the cycle.

Nothing has to be said, on the contrary, about the composition of the electrolyte, and about the current density value to be used in the process because the arrangement "in series" of the electrodes do not influence the chemic-physical reactions of the electrolytic process, so that the selection of said parameters have to be performed according to the same criteria of the other known processes.

On the contrary, as far as the difference of potential is concerned, it is necessary to remind that, on account of the higher electric resistance offered by the lead electrodes and due to the dioxide layer which will be formed on their anodic side, the required voltage for each cell, in the case of currents varying from 100 to 200 Amperes, varies between 1,85 and 2,05 volts and, of course, since a connection "in series" is considered, the potential difference in the apparatus must be equal to the sum of the potential differences of the single cells which compose this latter.

It will be advisable that the electrolying apparatus according to the present invention has to be provided with suitable devices which allow that all the possible electrolyte losses are to be collected and returned into the operative cycle, losses which could be due to packing means which do not offer a hermetical seal so that they do not cause undue problems. It is also necessary that collectors or other devices adapted to permit an easy emptying and filling of the electrolyzers with the electrolyte, are provided.

I claim:

1. An electrolytic process for the electrodeposition of removable copper sheets on the cathodic surfaces of bipolar lead sheet electrodes, each of said electrodes having an anodic surface directly opposite the cathodic surface thereof, said electrodes being immersed in an aqueous electrolytic solution of copper sulphate acidified by sulphuric acid, said lead sheet electrodes being arranged in series electrically with the first and last electrode in the series being connected between an electrical current source, said process including the following steps:

forming a plurality of separate similar electrolytic cells by installing each of the lead sheet electrodes in a separate modular carrying frame of a corrosion resistant and electrically non-conductive material, said frames being arranged side by side and connected together to form an integral assembly, continuously flowing said aqueous electrolytic solution from a distribution source thereof independently and separately through each of said cells in a flow path entering at the bottom of each cell, flowing through a discharge hole in the upper part of each cell which also provides the discharge of oxygen to the atmosphere, and then flowing downwardly through an outlet orifice back to the distribution source, said solution being flowed through flow breaking means located in the flow path for creating discontinuities in the flow so as to prevent the formation of shunt currents or current bypasses along the flow path.

2. An apparatus for use in the electro-deposition of removable cathodic copper sheets on the cathodic sides of bipolar insoluble lead sheet electrodes (3) having opposing cathodic and anodic sides, said apparatus including a plurality of electrolytic cells, each of said cells formed by a peripheral substantially rectangular frame (1) made of a corrosion resistant and electrically non-conductive material which carries one of said bipolar lead electrodes, said electrodes being immersed in an aqueous electrolytic solution, wherein the improvement comprises:

each frame (1) having a substantially rectangular shape and including four hollow members (1*a*,1*b*,1*c*, and 1*d*), first and second third and fourth of said hollow members (1*c* and 1*d*) being oriented horizontally, said third of said members (1*c*) being connected between said first and second of said members (1*a* and 1*b*) near the upper ends thereof, the fourth of said members (1*d*) being connected between said first and second members (1*a* and 1*b*) near the lower ends thereof, each frame (1) thereby defining an inner rectangular space (a,b,c,d) having an area equal to that of the copper sheet to electrolytic solution being separately fed from said distributor (8) to each of the inlet orifices (E) of the second members of said cells.

3. An apparatus according to claim 2, wherein the member (1*c*) of each frame (1) has a U-like cross section, while slits (1*c*') are arranged along the bottom of said member, which has one of its longitudinal sides higher than the other, to the upper edge of said higher side of said member (1*c*) the upper edge of a bipolar insoluble sheet electrode (3) being hung and fixedly connected thereto by means of a thin bar (5) having an inverted U shaped cross section so that said bar forms a longitudinally open channel of a width slightly less than the thickness of the electrode (3), said bar (5) being made of a non-conductive, elastically deformable material.

4. An apparatus according to claim 2, wherein the transverse lower member (1*d*) is constituted, in combination, of a lower element having U-shaped cross sections, the bottom (1*d*') of which is sloping from one to the other end of said member (1*d*), in the lowermost part of said bottom (1*d*') a discharge means (1*e*) being provided permitting the complete washing and emptying of the respective electrolyte circulation duct system of each electrolytic cell for periodic cleaning operations thereof.

5. An apparatus according to claim 2, wherein in the inner cavity or duct length of the vertical member (1*a*) an electrolyte flow breaking device (7) is provided consisting of a upper small tank, which receives the electrolyte flow and which is emptied by a siphon device, which intermittently permits the electrolyte to fall down into the underlaying electrolyte duct length, where two pluralities of short opposite sloping wall elements, are mounted, said duct length being so dimensioned as to be never filled entirely by the liquid amount coming out from said small tank, at each siphon discharge cycle, so that between the entrance section and the exit section of said device (7) at least one interruption of the electrolyte flow is created.

6. An apparatus according to claim 2 or 5, wherein it comprises a distributor (8) having an inlet upper chamber into which electrolyte is conveyed from the electrolyte storage tank, said upper chamber through a plurality of inlet orifices of equal cross section comunicating with a plurality of vertical ducts, separated from each other, into each of which an electrolyte flow breaking means (7') is arranged, similar to the breaking means (7') arranged in the member (1*a*) of each frame (1), said distribution ducts ending respectively at their lower ends with vertical pipe unions so shaped and spaced apart from each other as to be able to enter into the respective inlet orifices (E) of the plurality of hollow frames (1) of the apparatus.

7. An apparatus according to claim 2, wherein each of the bipolar sheet electrodes (3) has an area greater than the area (a, b, c, d), but such that their peripheral edges are positioned closely within the outline of the respective supporting frames (1), so that each electrode (3) has border portions apt to be clamped between two adjacent frames (1), while packing ribbons (6) are connected to each frame along its peripheral edges so that said ribbons (6) can ensure a peripherally hermetic seal of the electrolytic cells of the apparatus.

* * * * *